US009289695B2

(12) United States Patent
Sadri et al.

(10) Patent No.: US 9,289,695 B2
(45) Date of Patent: Mar. 22, 2016

(54) FOLDING TOY FIGURINE AND METHOD FOR MAKING SAME

(71) Applicant: REALLY BROTHERS, LLC, Brooklyn, NY (US)

(72) Inventors: Omid Sadri, New York, NY (US); Michael Weaker, North Potomac, MD (US)

( * ) Notice: Subject to any disclaimer, the term of this patent is extended or adjusted under 35 U.S.C. 154(b) by 0 days.

(21) Appl. No.: 13/650,511

(22) Filed: Oct. 12, 2012

(65) Prior Publication Data

US 2013/0095723 A1 Apr. 18, 2013

Related U.S. Application Data

(60) Provisional application No. 61/547,699, filed on Oct. 15, 2011, provisional application No. 61/649,332, filed on May 20, 2012.

(51) Int. Cl.

| | |
|---|---|
| ***A63H 3/16*** | (2006.01) |
| ***A63H 33/08*** | (2006.01) |
| ***B31B 1/88*** | (2006.01) |
| ***B31B 11/00*** | (2006.01) |
| ***A63H 33/16*** | (2006.01) |
| ***B31B 1/00*** | (2006.01) |
| ***B31D 5/04*** | (2006.01) |
| *A63H 3/08* | (2006.01) |

(52) U.S. Cl.

CPC ..... *A63H 33/08* (2013.01); *A63H 33/084* (2013.01); *A63H 33/16* (2013.01); *B31B 1/00* (2013.01); *B31B 1/88* (2013.01); *B31B 11/00* (2013.01); *B31D 5/04* (2013.01); *A63H 3/08* (2013.01); *B31B 2217/066* (2013.01); *B31B 2217/084* (2013.01); *B31B 2217/101* (2013.01)

(58) Field of Classification Search

CPC ..... A63H 33/08; A63H 33/084; A63H 33/16; A63H 3/005; A63H 3/00; B31B 1/00; B31B 1/88; B31B 11/00; B31B 2217/066; B31B 2217/084; B31B 2217/101; B31D 5/04; B65D 81/368; B65D 5/5021; B65D 5/324

USPC ..... 446/73, 75, 76, 77, 79, 80, 97, 98, 100, 446/101, 106, 108, 109, 110

See application file for complete search history.

(56) References Cited

U.S. PATENT DOCUMENTS

| | | | | | |
|---|---|---|---|---|---|
| 2,342,551 | A | * | 2/1944 | Levkoff | 229/151 |
| 3,018,583 | A | * | 1/1962 | Novotney | 446/73 |
| 3,440,747 | A | * | 4/1969 | Oliver | 40/539 |
| 3,447,672 | A | * | 6/1969 | Bailey et al. | 229/104 |
| 3,660,926 | A | * | 5/1972 | Lerner et al. | 446/73 |
| 3,695,514 | A | * | 10/1972 | Mascetti, Jr. | 229/406 |
| 4,326,356 | A | * | 4/1982 | Mason | 446/73 |
| 4,953,779 | A | * | 9/1990 | Densen | 229/125.19 |

(Continued)

*Primary Examiner* — Vishu Mendiratta

(57) ABSTRACT

A folding toy figurine includes a lid formed from a flat foldable stock and has a top wall and side walls when it is folded into erect position. The toy also has a box component which is formed from flat foldable stock which, when folded into erect position, has a bottom wall, walls and a hollow interior. At least one of side walls has a small slot therein and a lid fitting snugly over the box component to form a hollow box. The toy has parts that are loosely held inside the box. At least one of the parts is removable from the interior of the box and insertable into said small slot in side wall, from the exterior thereof. The invention also provides a method of making parts with boundaries for insertion into slots.

10 Claims, 12 Drawing Sheets

(56) References Cited

U.S. PATENT DOCUMENTS 5,402,930 A * 4/1995 Storms et al. ..... 229/125.28
2004/0007814 A1* 1/2004 Senart ..... 273/285
2009/0058003 A1* 3/2009 Nouhan, Jr. ..... 273/260
2011/0169220 A1* 7/2011 Nouhan, Jr. ..... 273/248
2012/0217259 A1* 8/2012 D'Hiet et al. ..... 221/45

* cited by examiner

FOLDING TOY FIGURINE AND METHOD FOR MAKING SAME

1. BRIEF DESCRIPTION OF THE PRESENT INVENTION

The present invention consists of the shown type of figurine toy which is made substantially of paperboard (but could also be made from another thin stiff sheet material, such as plastic.) The toy is comprised of four different types of components, all of which are made from the paperboard material. The component types are: the "Box Component," the "Lid," the "Base," and the "Parts." Each toy includes one Box Component, one Lid, one Base, and many Parts. The Box Component and the Lid are each folded and are then fit together to create the body of the figurine—and the Parts can be attached to the body by the user. All of these components—and the manner in which they are used—will be described in this document.

Further, the present invention includes a Part and Slot System and a method of making the same. The Part and Slot system is comprised of two features: PART and SLOT.

2. BRIEF DESCRIPTION OF THE DRAWINGS

Figure 23:
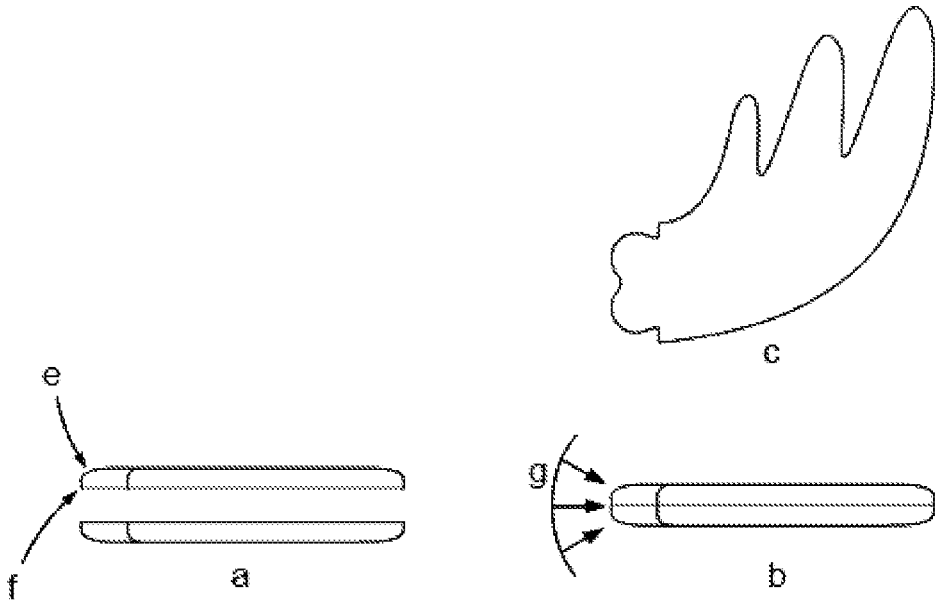

FIG. 23 includes various views of the PART before and after the two halves of the PART have been glued together.

Figure 24:
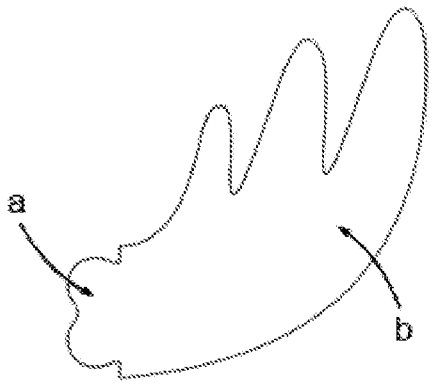

FIG. 24 is a front view of the PART.

Figure 25:
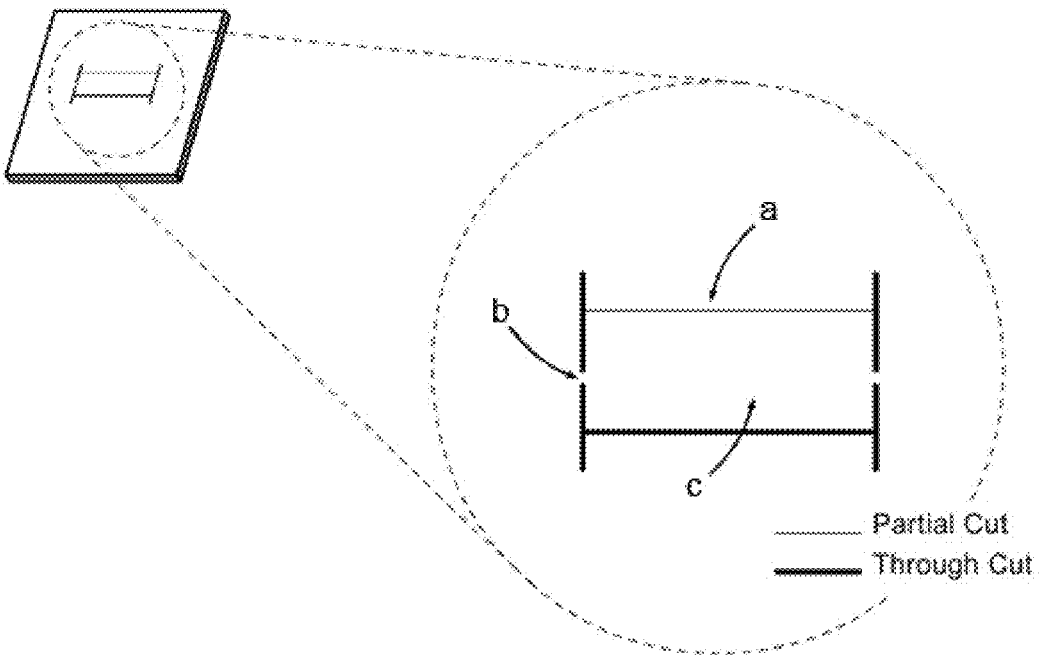

FIG. 25 is a detail plan view of the SLOT.

Figure 26:
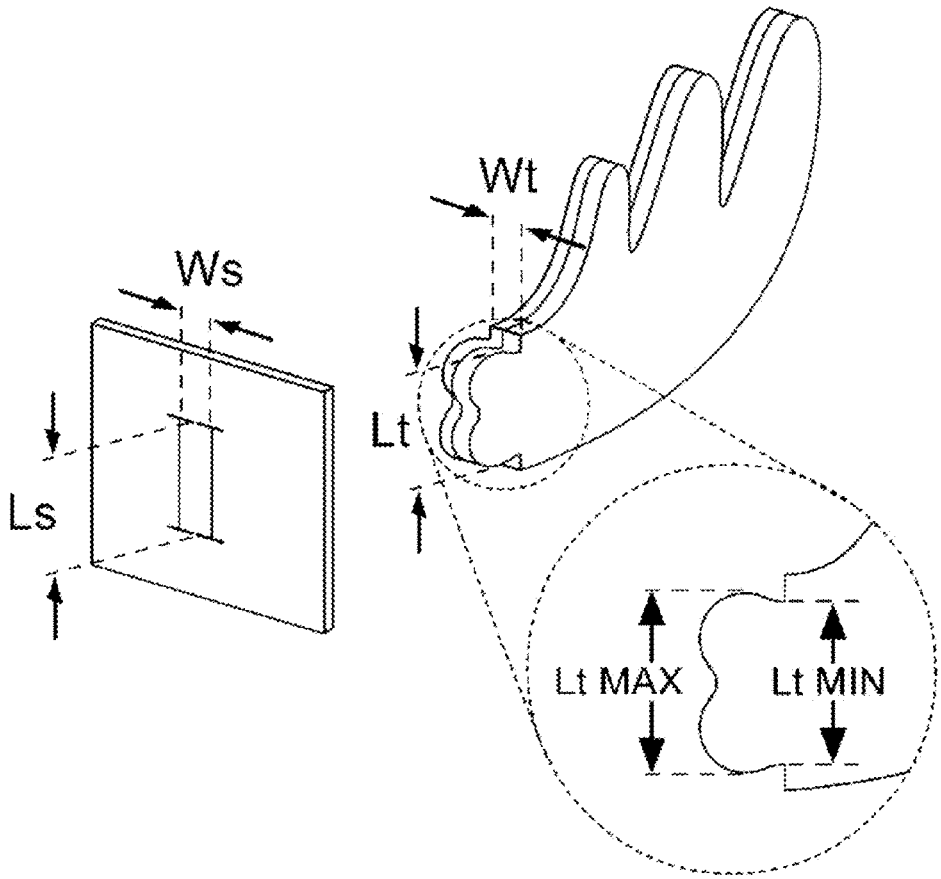

FIG. 26 is a perspective view of a PART and SLOT, with critical dimensions labeled, and with a front detail view of the PART.

Figure 27:
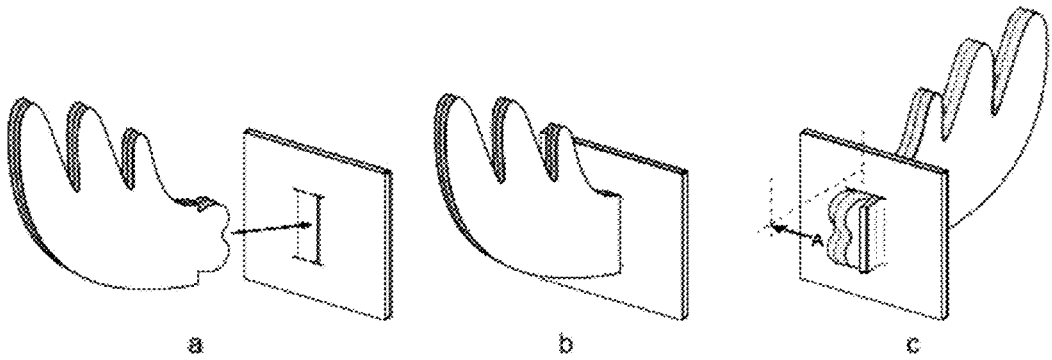
Figure 28:
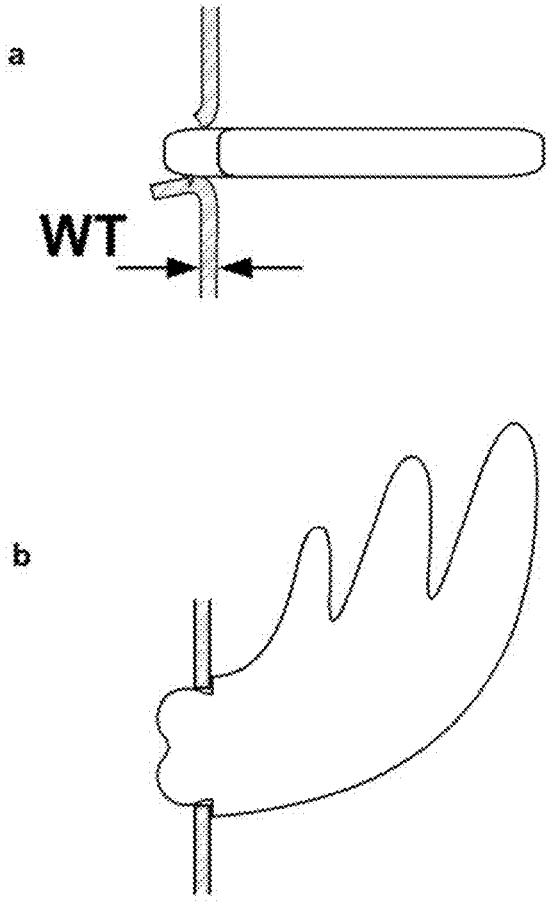

FIG. 27 shows a PART before and after being inserted into a SLOT seen from two perspective views FIG. 28 shows top and front views of the PART and SLOT assembly for thin sheet material.

Figure 29:
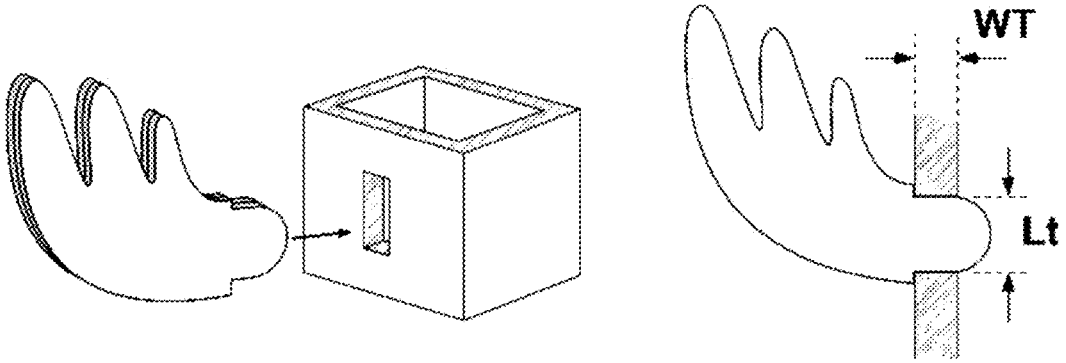

FIG. 29 shows perspective and front views of the PART and SLOT assembly for thin walled volume.

3. DESCRIPTION OF THE COMPONENTS WHICH COMPRISE THE PRESENT INVENTION

A. The "Box Component" and the "Lid"

Figure 1:
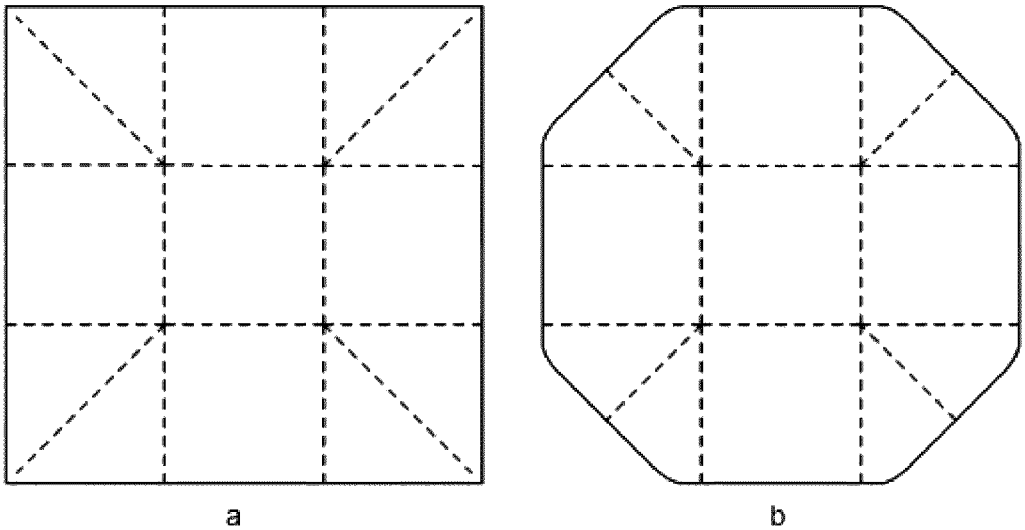
FIG. 1 shows plan views of the unfolded (flat) Box Component with dashed lines representing fold lines.
Figure 2:
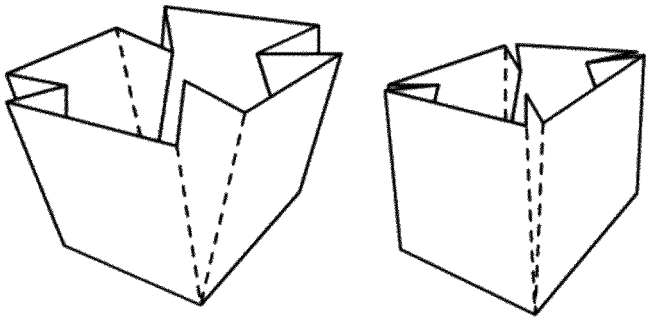
FIG. 2 is a perspective view of the Box Component in a partially-folded state (left) and a fully-folded state (right).

The Box Component and the Lid can be fit together (as described below) to form a box (which may be referred to as "The Box" from now on) that is unique by comparison with existing boxes that are made of a folded sheet material (such as paper), and is critical to the present invention. (That is, "The Box" is an assembly comprised by the "Box Component" and the "Lid.") The Box Component is the largest of the four component types that comprise the invention. The Box Component is comprised of one square piece of paperboard (or another type of sheet material that can be folded). This square is scored along four lines. These four score lines visually divide the square into nine smaller squares. Four additional shorter score lines are made, which, in a folded state, form webs. Each of the shorter score lines extends from one of the four corners of the square piece of paperboard toward the center of the piece of paperboard (FIG. 1*a*). The corners of the square piece of paperboard may also be cut during manufacture, creating an eight-sided piece of paperboard from the original square (FIG. 1*b*). The eight score lines, previously described, aid, in folding the piece of paperboard, that comprises the Box Component. A cubic box that is open on one side is formed by folding the scored paperboard along the eight score lines (FIG. 2). In a folded state, the Box Component includes pockets extending interiorly that are formed from the webs.

Figure 3:
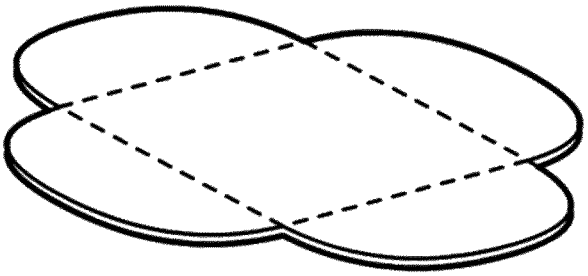
FIG. 3 is a perspective view of the unfolded (flat) Lid with dashed lines representing fold lines.
Figure 4:
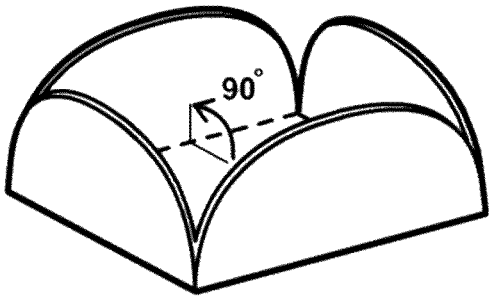
FIG. 4 is a perspective view of folded Lid.

The Lid is used to cover the open side of the folded Box Component and prevent the Box Component from unfolding. The Lid is made of paperboard and is in the shape of a square with one flap extending from each of the four sides of the square (FIG. 3). The square-shaped portion of the Lid is approximately the same size as the square-shaped opening of the folded Box Component. The Lid is scored along four lines. These four score lines visually define the square-shaped potion of the Lid, thereby making the square-shaped portion of the Lid visually distinct from the flaps. The flaps are folded along the score lines until each flap is positioned with an approximately 90° angle between the surface of the flap and the surface of the square-shaped portion of the Lid (FIG. 4).

Figure 5:
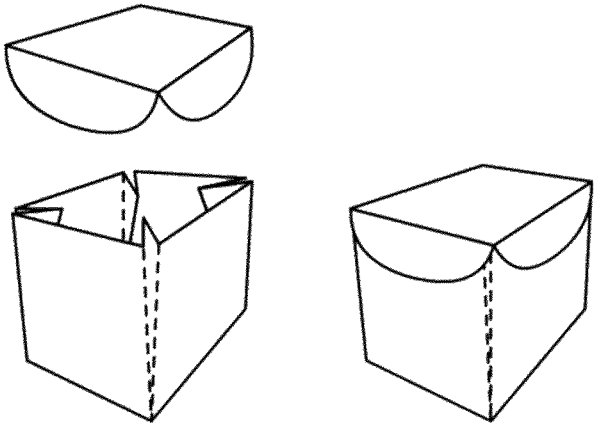
FIG. 5 is a perspective view of the Lid off (left) and on (right) the Box Component with Lid flaps on the outside of the Box Component.
Figure 6:
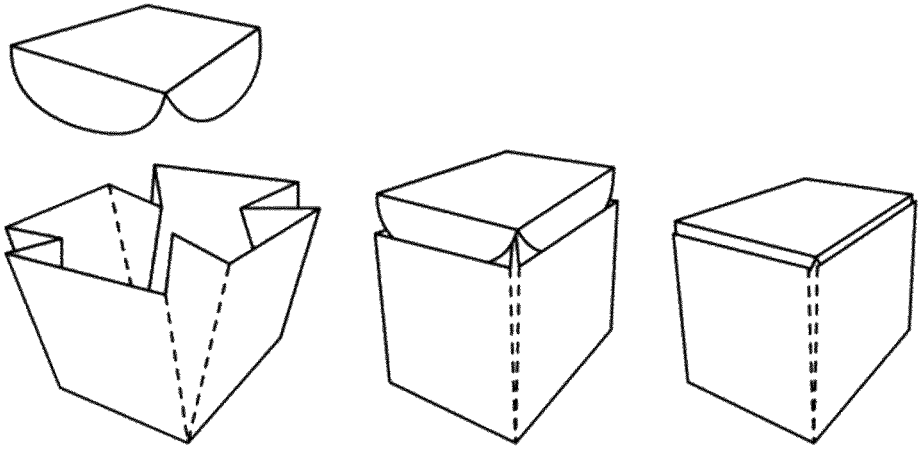
FIG. 6 is a perspective view of the Lid before being inserted into the Box Component (left), partially inserted into the Box Component (middle), and fully inserted into the Box Component (right).

With the flaps in the described position, gaps are formed between the flaps and the Lid can be used to cover the open side of the folded Box Component (thereby creating The Box) in two different ways:

i) With the square-shaped portion of the Lid covering the open side of the folded Box Component, the flaps of the Lid can remain on the outside of the Box Component. The Lid can then be affixed to the Box Component via the application of an adhesive between each flap and the corresponding side of the Box Component (FIG. 5).

ii) Or, with the square-shaped portion of the Lid covering the open side of the folded Box Component, the flaps of the Lid can be inserted into the Box Component. The flaps are inserted into the Box Component so that each flap is positioned between the interior folds of the Box Component and an outer wall of the Box Component (FIG. 6, middle and FIG. 6, right). In this case, adhesive is not needed. The flaps of the Lid, inserted in to the Box Component, act as a mechanical locking mechanism by physically blocking the movement required by the Box Component to unfold. The Box that results when this particular method is employed to assemble the Box Component and the Lid is unique by comparison with existing boxes that are made of a folded sheet material (such as paper). (That is, the way that the Box Component is folded and the method in which the Lid both closes The Box and prevents the Box Component from unfolding, make The Box unique when compared to existing boxes.) (Note: Although not necessary, adhesive can be added between the Box Component and the Lid to prevent the Lid from becoming dislodged before the to is purchased.)

B. The "Base"

Figure 7:
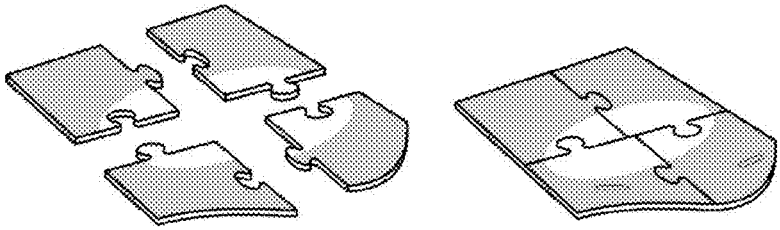
FIG. 7 is a perspective view of the Base unassembled (left) and assembled (right) (shading represents cosmetic surface graphics).
Figure 17:
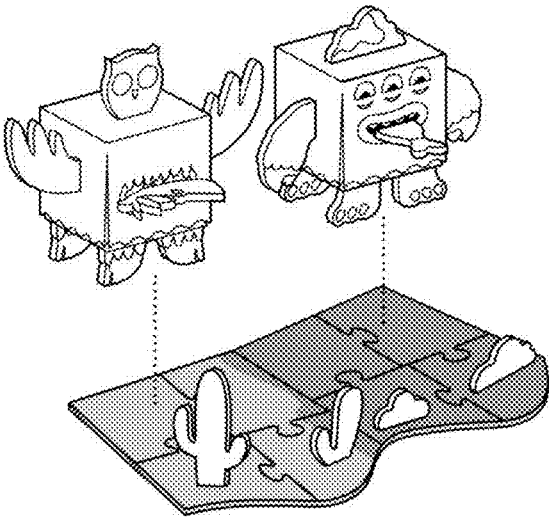
FIG. 17 is a perspective view of two assembled toys that are about to be placed onto two adjacent Bases for display (shading represents cosmetic surface graphics).

The Base component may—or may not—be included with the toy, and is comprised of some number of flat paperboard parts. In the example shown in the illustrations, the Base is comprised of four parts—and each of these parts is roughly the shape of a square. These square-shaped parts connect to each other, making one single, larger paperboard square (FIG. 7). The outer edges of the four parts include complementary male and female features that facilitate their connection (similar to the way that pieces in a traditional paperboard puzzle connect). The Base component serves as a base for the toy to stand on (FIG. 17). The Base is colored with graphics to provide a theatrical stage-like backdrop—or setting—for the toy.

C. The "Parts"

Figure 8:
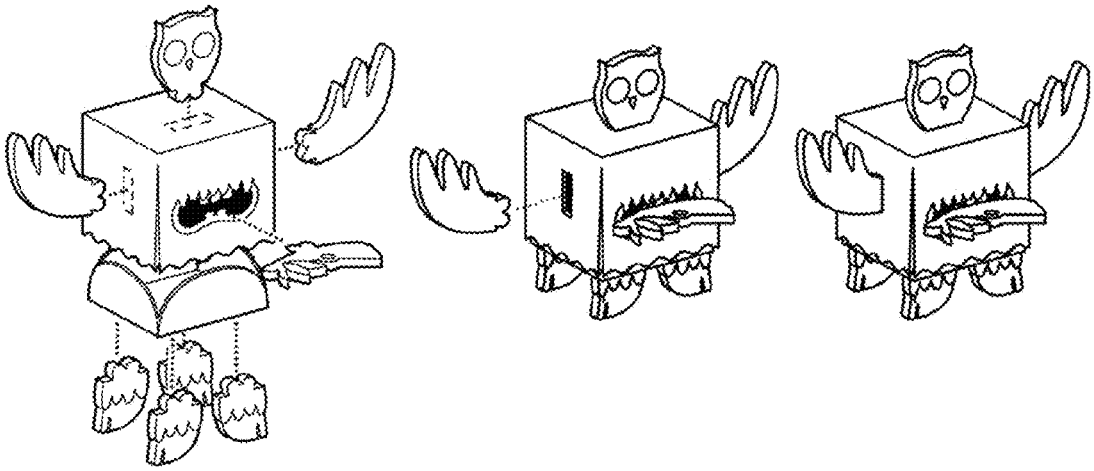
FIG. 8 is a perspective view of the Parts before being inserted into the slots on Lid and Box Component (left), all but one of the Parts inserted (middle), and all the Parts inserted (right).
Figure 9:
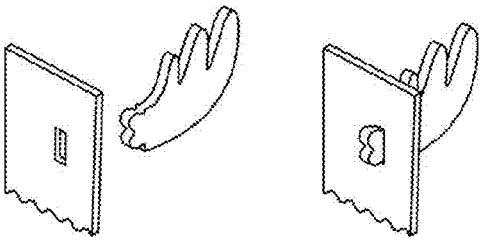
FIG. 9 is a perspective view of a Part before being inserted into a slot (left) and after being inserted (right).
Figure 10:
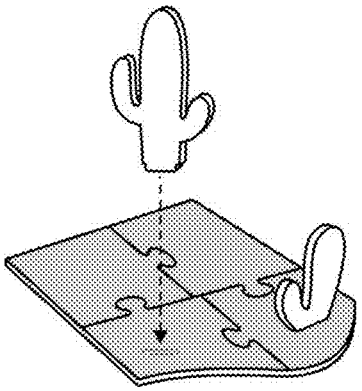
FIG. 10 is a perspective view of a "Scenery" Part before being inserted into a slot on the Base and another Part that has already been inserted into a slot on the Base (shading represents cosmetic surface graphics).

Each toy includes many Parts. The Parts are flat pieces of paperboard [but may be made from another material, or may be sculpted shapes that are three-dimensional; not flat (e.g. molded parts made of hard plastic)] and are inserted into small slots in the Box Component, Lid, and Base (FIG. 8). (Note: The Box Component shown in FIG. 8 and all figures that follow include a decorative wavy edge. Dashed lines are used on the sides of the Box Component in FIG. 8, left to indicate the perforated outline of slots. Dashed lines will be used for this purpose throughout this document. Dotted lines are used in FIG. 8 and later figures to indicate the path that Parts will follow as they approach, and are inserted, into the slots.) On one end of each Part, there is a male feature that is inserted into a female slot feature on the Box Component, Lid, or Base (FIG. 9). (Note: In FIG. 9, the slot is shown on a generic piece of material to exemplify all slots on the Box Component, Lid, and Base.) These slots may be open—or, the outline of these slots may be perforated—so that a user can use the male feature on the Parts to punch out the material in the slots when inserting the Parts. (For additional stiffness, and to aid a user who is punching out the material inside perforated slots, the Parts may be made from a slightly thicker paperboard material than the Box Component, Lid, and Base.) The Parts that are attached to the Box Component and Lid are shaped and colored to represent the "body parts" of the toy. The Parts that are attached to the Base are shaped and colored to represent "scenery" and contribute to the stage-like setting created by the Base (FIG. 10).

4. DESCRIPTION OF THE PACKAGING (TWO EMBODIMENTS OF THE INVENTION)

One of the unique characteristics of the figurine toy product that is the present invention is that The Box functions both as the body of the figurine and as the retail packaging for the product. The fact that The Box is also the packaging affects the user's experience with the toy. In this section, two embodiments of the toy will be described. The two embodiments are substantially the same, but for each embodiment, a different approach to the packaging (and the way in which the user interacts with the packaging) will be described.

A. Turning the Box Component Inside-Out

Figure 11:
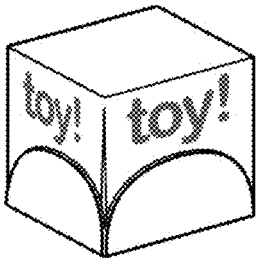
FIG. 11 is a perspective view of an example of exterior display graphics on The Box

When the toy appears on the store shelf before purchase, the Lid is attached to the Box Component to create The Box via the method described in 2.A.i, above. The exterior of The Box displays graphics for merchandising the product (FIG. 11).

Figure 12:
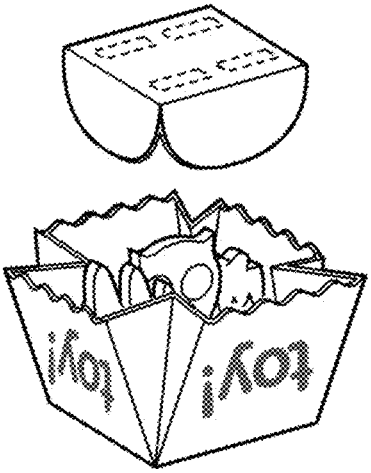
FIG. 12 is a perspective view of the Box Component (upside-down) with Parts inside and the Lid removed.
Figure 13:
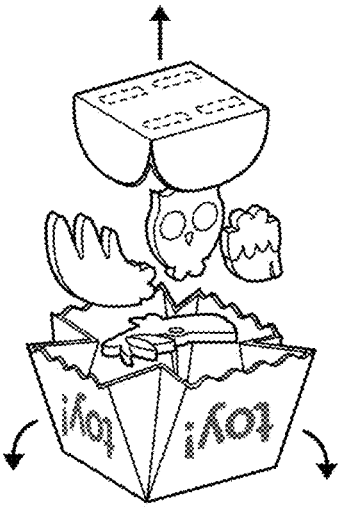
FIG. 13 is a perspective view of the Lid removed from the Box Component and the Parts removed from inside of The Box (exterior of Box Component shows merchandising graphics).

The Box contains the Parts and disassembled four-part Base (FIG. 12).

After purchasing the toy, the user opens The Box by breaking the adhesive seal between the Lid and the Box Component. The user removes the Parts and Base from inside The Box.

Figure 14:
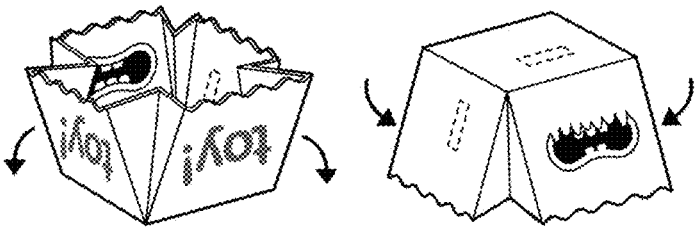
FIG. 14 is a perspective view of the Box Component before being turned inside-out to display graphics that depict the body of the figurine toy (left), and after being turned inside-out (right).

On the inner surface of the Box Component, colorful graphics are printed to represent the body texture of the toy. To display those graphics on the exterior of the Box Component, the user turns the Box Component inside-out (FIG. 14). (The user can do this due to the score lines and unique shape of the Box Component.)

Figure 15:
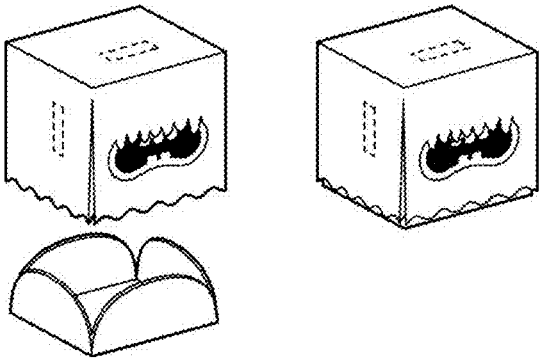
FIG. 15 is a perspective view of the Lid before being inserted into the Box Component to create The Box (left), and after being inserted (right).

After turning the Box Component inside-out, the user secures the Lid onto the Box Component to create The Box via the method described in 2.A.ii (which does not require adhesive), above (FIG. 15).

Figure 16:
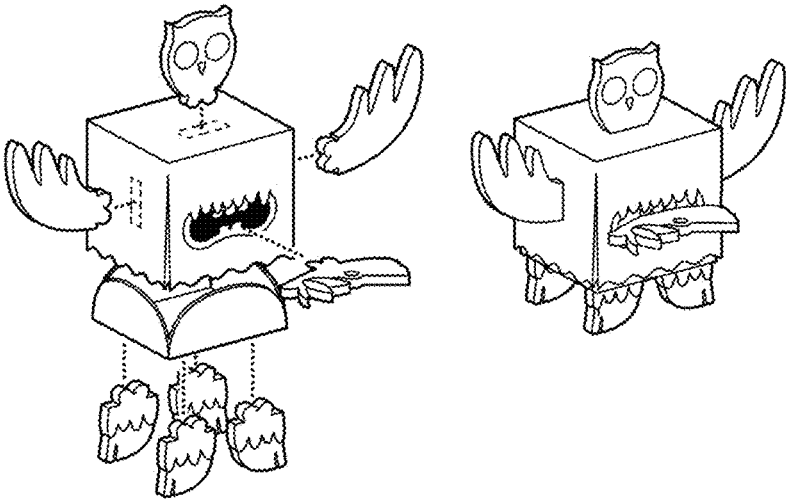
FIG. 16 is a perspective view of the The Lid before being inserted into the Box Component and the Parts before being inserted into the slots on the Box Component and Lid (left)—and after (right).

After creating The Box with the Box Component's colorful graphics on the exterior and merchandising graphics hidden in the interior, the user inserts the Parts into the slots on the Box Component and Lid (FIG. 16).

If the Base is included, the user also assembles the Base and attaches the "scenery" Parts to the Base (FIG. 10).

The fully-assembled toy is placed on the Base for display. Multiple toys can be displayed together by placing their Bases side-to-side (FIG. 17). Multiple Bases can be placed side-to-side. The graphics on each Base are designed so that when two (or more) Bases are placed side-to-side, there is smooth visual continuity between the Bases. The shading on the Bases in FIG. 17 represents surface graphics on the bases. The ability to "connect the Bases" provides an incentive to the user to acquire more toys.

B. The Sleeve

Figure 18:
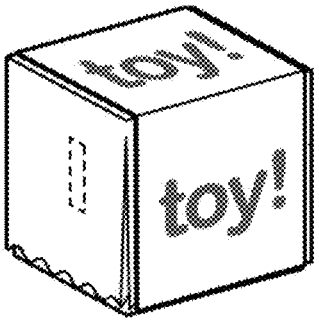
FIG. 18 is a perspective view of the The Box with a sleeve that is wrapped around The Box.

An alternative embodiment of the toy is as follows:

When the toy appears on the store shelf before purchase, the Lid is attached to the Box Component to create The Box via the method described in 2.A.ii, above. A paper (or other material) sleeve with merchandising information is wrapped around The Box in order to prevent the Lid from becoming dislodged before the toy is purchased (FIG. 18).

Figure 19:
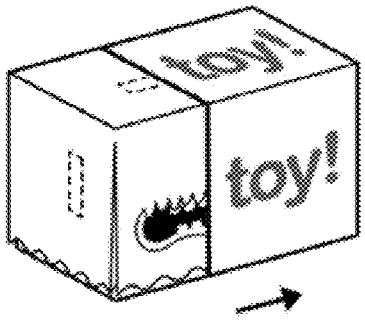
FIG. 19 is a perspective view of the sleeve being slid to remove the sleeve from The Box.
Figure 20:
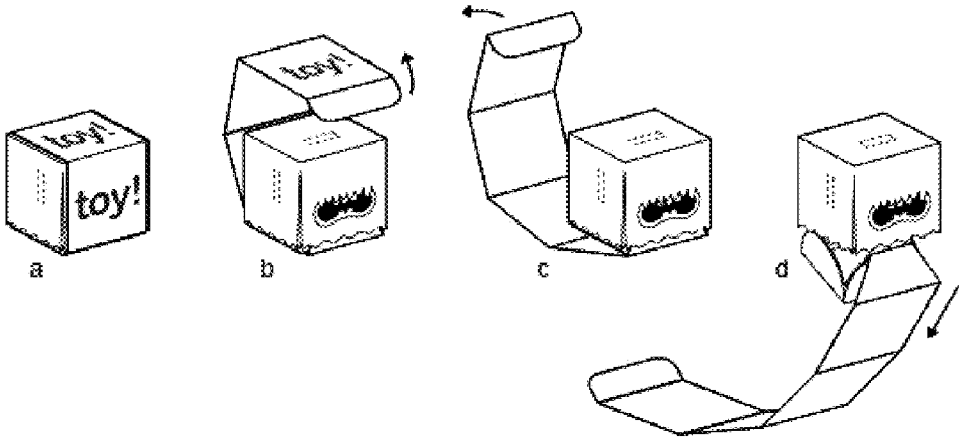
FIG. 20 shows perspective views of the sleeve in various positions as the sleeve is being unwrapped to remove the sleeve from The Box.

After purchasing the toy, the user opens The Box by either sliding the sleeve (FIG. 19) or by pulling the exposed end of the sleeve to unwrap the sleeve from around The Box. The other end of the sleeve is hooked over one tab of the Lid, so that when the sleeve is unwrapped from The Box, the sleeve pulls on the Lid, removing the Lid from the Box Component along with the sleeve (FIG. 20*a*-FIG. 20*d*). FIG. 20*a* is a perspective view of the The Box with a sleeve that is wrapped around the Box. FIG. 20*b* is a perspective view of the sleeve partially unwrapped from The Box, revealing the graphics on the The Box that were previously covered by the sleeve in FIG. 20*a*. In FIG. 20*c*, the sleeve is more unwrapped than in FIG. 20*b*. FIG. 20*d* is a perspective view of sleeve being pulled downward to remove the Lid from the Box Component.

Figure 21:
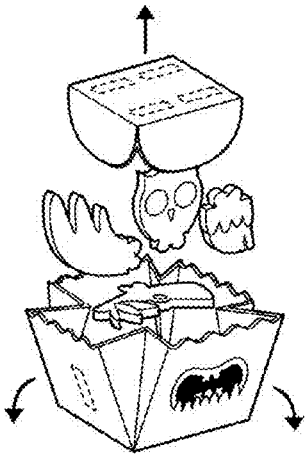
FIG. 21 is a perspective view of the Lid removed from the Box Component and the Parts removed from inside of The Box (exterior of Box Component shows graphics that depict the body of the figurine toy).

The user removes the Parts from inside the Box Component. On the outer surface of the Box Component, colorful graphics are printed to represent the body texture of the toy (FIG. 21).

The user secures the Lid onto the Box Component to create The Box via the method described in 2.A.ii (which does not require adhesive), above (FIG. 15). After creating The Box with the Box Component's colorful graphics on the exterior, the user inserts the Parts into the slots on the Box Component and Lid (FIG. 16).

5. METHOD FOR MAKING THE PART AND SLOT SYSTEM

The present invention includes a Part and Slot System that is comprised of two features: PART and SLOT.

A. The PART

Figure 22:
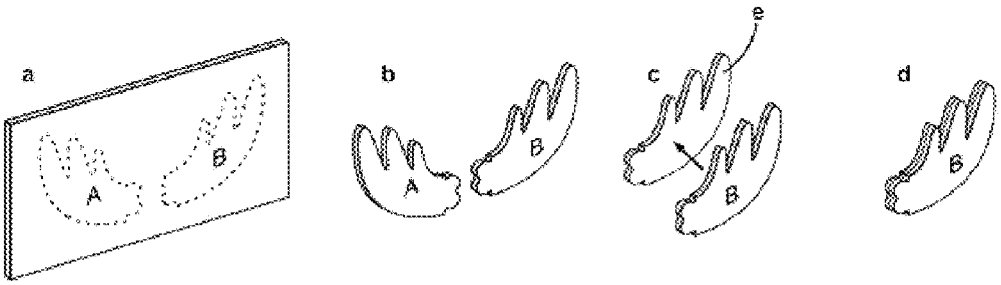
FIG. 22 is a perspective view of four stages of a method for creating the PART.

The PART is a two-dimensional shape with a thickness and is made of a thin sheet material—ideally, paperboard. The PART is comprised by two halves, A and B (FIG. 22). To make the PART, the colorful graphics for half A and B are first printed on one side of a piece of paperboard. (In figure FIG. 22*a*, the graphics would be applied to the side of the paperboard marked with the "A" and "B".) Halves A and B are then cut (by any method, ideally, die cut) out of the piece of paperboard (FIG. 22*b*). Halves A and B are identical mirrored shapes. A and B are then laminated or glued together (with colorful graphics facing out) to create a thicker material (FIG. 22*c* & FIG. 22*d*). The back of half A is shown in FIG. 22*e*. The back of half A does not have any applied graphics and would be in contact with glue if glue is used to bond half A to half B.

The process of die cutting the two halves and then gluing or laminating them together, allows for the finished PART to be twice as thick as the original paperboard material. If the thickest paperboard (or other material) that can be accurately cut via die cutting is used, then the finished PART will be thicker than the thickest material that can be cut using existing die cutting tools.

When a material is die cut, the cutting blade enters through one side of the material (entering side) and exits the other (exiting side). The edges of the resulting cut shape on the entering side of the material are slightly rounded (FIG. 23*e*) and the edges on the exiting side are sharp (FIG. 23*f*). When the two halves of the PART are glued or laminated, the exiting sides of each half are glued. As a result, the edges of the finished PART are tapered (FIG. 23*g*). FIG. 23*a* is a bottom view of the PART before the two halves have been glued. FIG. 23*b* is a bottom view of the PART after the halves have been glued. FIG. 23*c* is a front view of the PART shown in FIG. 23*a* and FIG. 23*b*. The tapered edge shown in FIG. 23*g* is very important because it helps prevent damage to the edges of the PART when the PART is inserted into the SLOT (described in the following section). The taper also helps guide the PART into the SLOT.

B. The SLOT

The SLOT is a feature on the surface of a thin sheet material or thin-walled volume that acts as a receptacle for the PART.

5 Description of the Part and Slot System with the Slot on a Thin Sheet Material In the case of a thin sheet material, such as paperboard, The SLOT feature is constructed of a combination of through cuts and partial cuts.

There are three features that comprise the SLOT: Flap (FIG. 25*c*), Nicks (FIG. 25*b*), and Hinge (FIG. 25*a*).

The Nicks are uncut "tags" of the substrate material, which connect the Flap to the surrounding material.

The Hinge is a line that is partially cut.

The Flap is an area defined by a series of through cuts and the Hinge.

The PART has two features: the Tab (FIG. 24*a*) and the Body (FIG. 24*b*).

The length (Lt) and width (Wt) of the Tab features of the PART are slightly greater than the length (Ls) and width (Ws) of the SLOT (FIG. 26).

To connect the PART to the SLOT, The Tab feature of the PART is pushed against the Flap feature of the SLOT. By applying pressure to the Flap, the Nicks are broken, allowing the Flap to swing open at the Hinge. FIG. 27*a* shows the PART before being inserted into the SLOT. The PART is then pushed into the SLOT until the Tab "snaps" into the SLOT and the Body feature of the PART is flush with the surrounding surface of the SLOT (FIG. 27*b*). FIG. 27*c* is same FIG. 27*b* but seen from the opposite side.

A "snap fit" occurs because the maximum length of the Tab (FIG. 26, Lt Max) is greater the length of the slot (FIG. 26, Ls) and the width of the Tab (FIG. 26, Wt) is greater than the width of the SLOT (FIG. 26, Ws). Specifically, as the Tab is inserted in the SLOT, the edges of the SLOT deform slightly to accommodate the maximum length of the Tab (FIG. 26, Lt Max). After the maximum length of the Tab (FIG. 26, Lt Max) passes through the SLOT opening, the minimum length of the Tab (FIG. 26, Lt MIN) allows the edges of the SLOT to relax, holding the PART in place (FIG. 28*b*).

Once the Tab is pushed through the SLOT, the width of the Tab is squeezed by the smaller width of the SLOT. Additionally, the Flap pushes against the Tab of the PART, providing friction to help hold the PART in place (FIG. 28*a*).

6. DESCRIPTION OF THE PART AND SLOT SYSTEM WITH THE SLOT ON A THIN WALLED VOLUME

In the case of a thin-walled volume made of a material such as molded plastic or machined wood, the SLOT appears as a rectangular hole (FIG. 29, left). FIG. 29 (left) shows a perspective view of the PART before being inserted into the SLOT in a thin-walled volume. FIG. 29 (right) shows a front view of the PART and a section view of the SLOT where the PART has already been inserted into the SLOT. In the case of the SLOT on a thin-walled volume, the Tab component of the PART may have a single consistent length (FIG. 29, Lt).

In the case of the thin sheet material, "snap fit" was used to attach the PART to the SLOT. In the case of the thin-walled volume, the PART is attached to the SLOT using "friction fit." This is possible because the wall thickness of the volume (FIG. 29, WT) is greater than the thickness of the thin sheet material (FIG. 28*a*, WT). The interior surfaces of the SLOT are therefore thicker. This means that there is more surface contact between the interior surfaces of the SLOT and the Tab of the PART. This surface contact provides adequate friction to hold the PART in place. Specifically, a "friction fit" occurs because there is interference between the Tab and the SLOT. Interference is created by making the length and width of the Tab slightly greater than the length and width of the SLOT. The Tab is pushed into the SLOT until the Body feature of the PART is flush with the surrounding surface of the SLOT (FIG. 29, right).

We claim:

1. A foldable toy, comprising:

a lid formed from a first unitary piece of generally stiff flat foldable stock, and when folded into erect position having a top wall and four side walls, the top wall and the side walls being connected by fold lines, and gaps being located between each one of the side walls and an adjacent one of the side walls;

a box component formed from a second unitary piece of generally stiff flat foldable stock, and when folded into erect position having a bottom wall and four side walls, the side walls being connected to the bottom wall by fold lines, and each of the side walls being connected to an adjacent one of the side walls by a web so as to form four webs, each one of the webs being folded interiorly of the box component to form a generally planar interior wing with an interior facing edge, each pair of adjacent wings and respective side wall between such wings defining a receiving pocket, a first width of each pocket being a length of the respective side wall;

each side wall of the lid corresponding to a respective pocket in the box component and having a width less than the first width of the corresponding respective pocket;

each side wall of the lid being removably and snugly insertable into the corresponding respective pocket in the box component and portions of the wings being located in the gaps between adjacent side walls of the lid to form a hollow box, wherein when the lid is so engaged to the box component, each side wall of the lid is captured between the wings of the respective pocket such that interaction between the side walls of the lid and the wings of the pockets prevent the box component from unfolding; and an elongated multi-panel, foldable sleeve having first and second ends and a body, wherein the sleeve is engaged at the first sleeve end to one of the side walls of the lid, the body of the sleeve is wrapped over the lid and the box component; and parts arranged inside of the box, each of the parts being removable from the interior of the box and a plurality of said parts releasably connectable with at least one of the side walls of the lid and the box component.

2. A foldable toy as set forth in claim 1, wherein the top wall of the lid is square and the bottom wall of the box component is square and the four side walls of the box component are square, whereby the lid and the box component form a cube.

3. A foldable toy as set forth in claim 1, wherein at least two of the walls of the box component have small slots and the top wall of the lid has a small slot, the parts having a variety of shapes and being insertable into said slots.

4. A foldable toy as set forth in claim 3, wherein the parts each have an insertable male leading edge.

5. A foldable toy as set forth in claim 4, wherein the parts resemble components of a body.

6. A foldable toy as set forth in claim 1, wherein the stock of the lid has four score lines and the stock of the box component has eight score lines.

7. A foldable toy as set forth in claim 1, wherein each of the parts are insertable into a slot in either the lid or the box component.

8. A foldable toy as set forth in claim 1, wherein the bottom wall and the side walls of the box component include an interior surface that when folded into the erect position forms an interior space, said interior surface contains graphics, and the box component is reversible to convert the interior space containing the graphics to an exterior surface that contains the graphics.

9. The foldable toy of claim 1, wherein each said pocket has a second width, the second width being a distance between the interior facing edge of each said wing at a point furthest from the bottom wall; the first width of the pocket being greater than the second width of the pocket; and wherein the width of each side wall of the lid is greater than the second width of the corresponding pocket.

10. The foldable toy of claim 1, wherein the first end of the sleeve is engaged to the respective side wall of the lid by being hooked over said respective side wall.

* * * * *